US011808522B2

(12) United States Patent
Nishioka et al.

(10) Patent No.: US 11,808,522 B2
(45) Date of Patent: Nov. 7, 2023

(54) RESERVE TANK AND REFRIGERANT CIRCUIT

(71) Applicants: TOYOTA JIDOSHA KABUSHIKI KAISHA, Toyota (JP); SUBARU CORPORATION, Tokyo (JP)

(72) Inventors: Hideo Nishioka, Toyota (JP); Hironobu Sakamoto, Okazaki (JP)

(73) Assignees: TOYOTA JIDOSHA KABUSHIKI KAISHA, Toyota (JP); SUBARU CORPORATION, Tokyo (JP)

( * ) Notice: Subject to any disclaimer, the term of this patent is extended or adjusted under 35 U.S.C. 154(b) by 0 days.

(21) Appl. No.: 17/675,625

(22) Filed: Feb. 18, 2022

(65) Prior Publication Data

US 2022/0282926 A1 Sep. 8, 2022

(30) Foreign Application Priority Data

Mar. 3, 2021 (JP) ..... 2021-033801

(51) Int. Cl.
*F28D 1/053* (2006.01)
*F28F 9/02* (2006.01)
*F28D 21/00* (2006.01)

(52) U.S. Cl.
CPC ..... *F28D 1/05391* (2013.01); *F28F 9/0204* (2013.01); *F28F 9/0278* (2013.01); *F28D 2021/0085* (2013.01)

(58) Field of Classification Search
CPC ..... F28D 1/05391; F28D 2021/0085; F01P 11/029; F28F 9/0204; F28F 9/0278
See application file for complete search history.

(56) References Cited

U.S. PATENT DOCUMENTS 3,080,857 A * 3/1963 Middendorf ..... F01P 7/165 123/41.1
4,480,598 A * 11/1984 Berrigan ..... F01P 11/029 123/41.27
4,738,228 A * 4/1988 Jenz ..... F01P 11/029 123/41.27

(Continued)

FOREIGN PATENT DOCUMENTS

GB 2582543 A 9/2020
JP 2017101573 A * 6/2017

(Continued)

*Primary Examiner* — Tho V Duong
*Assistant Examiner* — Raheena R Malik
(74) *Attorney, Agent, or Firm* — Dinsmore & Shohl LLP

(57) ABSTRACT

A reserve tank includes a plurality of chambers, including a first chamber, a second chamber, and at least one intermediate chamber, a first inflow port connected to the first chamber, a first outflow port connected to the first chamber, a second inflow port connected to the second chamber, a second outflow port connected to the second chamber, and a plurality of partition walls separating the chambers. Each of the partition walls is provided with a corresponding one of a plurality of refrigerant flow ports. A specific refrigerant flow port includes a first through hole and a second through hole that pass through a specific partition wall and are separated from each other. The specific refrigerant flow port being a refrigerant flow port provided in the specific partition wall among the partition walls.

6 Claims, 7 Drawing Sheets

(56) References Cited

U.S. PATENT DOCUMENTS

| | | | | |
|---|---|---|---|---|
| 5,139,082 | A * | 8/1992 | McEachern, Jr. | F01P 11/028 165/104.32 |
| 5,680,833 | A * | 10/1997 | Smith | F01P 11/029 165/104.32 |
| 6,216,646 | B1 * | 4/2001 | Smith | F01P 11/029 165/104.32 |
| 6,364,213 | B1 * | 4/2002 | Baltz | F01P 11/00 237/12.3 B |
| 9,759,123 | B2 * | 9/2017 | Le Poul | F01P 11/029 |
| 10,823,044 | B2 * | 11/2020 | Hügel | F01P 11/029 |
| 2002/0157621 | A1 * | 10/2002 | Lefrancois | F01P 11/029 123/41.54 |
| 2006/0118067 | A1 * | 6/2006 | Hewkin | F01P 11/0238 123/41.54 |
| 2008/0141955 | A1 * | 6/2008 | Young | F01P 11/029 123/41.51 |
| 2010/0006577 | A1 * | 1/2010 | Koshino | F01P 11/029 220/501 |
| 2011/0062163 | A1 * | 3/2011 | Hewkin | F01P 11/029 220/562 |
| 2015/0345368 | A1 | 12/2015 | Le Poul et al. | |
| 2019/0078497 | A1 | 3/2019 | Enomoto et al. | |
| 2020/0158059 | A1 * | 5/2020 | Sakata | F02M 35/1216 |
| 2021/0001354 | A1 * | 1/2021 | Sakata | F01P 11/028 |
| 2021/0301713 | A1 * | 9/2021 | Komatsu | F01P 11/029 |
| 2022/0099017 | A1 * | 3/2022 | Sakata | F01P 11/04 |
| 2022/0134906 | A1 * | 5/2022 | Schoeneman | H01M 10/613 429/120 |
| 2022/0154628 | A1 * | 5/2022 | Okabe | F01P 11/029 |
| 2022/0155032 | A1 * | 5/2022 | Sakata | F01P 11/029 |

FOREIGN PATENT DOCUMENTS

| | | | |
|---|---|---|---|
| JP | 2017-150352 | A | 8/2017 |
| JP | 2019-060275 | A | 4/2019 |
| JP | 2020-081970 | A | 6/2020 |
| WO | 2020246422 | A | 12/2020 |

* cited by examiner

RESERVE TANK AND REFRIGERANT CIRCUIT

CROSS-REFERENCE TO RELATED APPLICATION

This application claims priority to Japanese Patent Application No. 2021-033801 filed on Mar. 3, 2021, incorporated herein by reference in its entirety.

BACKGROUND

1. Technical Field

The technology disclosed in the present specification relates to a reserve tank and a refrigerant circuit.

2. Description of Related Art

Refrigerant flows into a reserve tank disclosed in Japanese Unexamined Patent Application Publication No. 2020-081970 from the outside. The refrigerant is retained in the reserve tank and then flows out of the reserve tank. While the refrigerant is retained in the reserve tank, air bubbles are removed from the refrigerant.

SUMMARY

The present disclosure proposes a reserve tank in which refrigerant of a plurality of systems can flow within and flow paths of the refrigerant can be switched internally. Also, a technology capable of suppressing intermingling of refrigerants of different systems inside in this type of reserve tank is proposed.

A reserve tank according to a first aspect of the present disclosure includes a plurality of chambers, including a first chamber, a second chamber, and at least one intermediate chamber, a first inflow port connected to the first chamber, a first outflow port connected to the first chamber, a second inflow port connected to the second chamber, a second outflow port connected to the second chamber, and a plurality of partition walls separating the chambers, including a first partition wall and a second partition wall. The first partition wall separates between the first chamber and the at least one intermediate chamber. The second partition wall separates between the second chamber and the at least one intermediate chamber. Each of the partition walls is provided with a corresponding one of a plurality of refrigerant flow ports. The refrigerant flow ports include a first refrigerant flow port provided in the first partition wall and a second refrigerant flow port provided in the second partition wall, are configured such that the refrigerant flows from the first chamber to the second chamber via the at least one intermediate chamber and the refrigerant flow ports. A specific refrigerant flow port includes a first through hole and a second through hole that pass through a specific partition wall and are separated from each other, and the specific refrigerant flow port is the refrigerant flow port provided in the specific partition wall among the partition walls.

In this reserve tank, a flow path that flows from the first inflow port to the first outflow port via the first chamber (hereinafter referred to as "first flow path"), and a flow path that flows from the second inflow port to the second outflow port via the second chamber (hereinafter referred to as "second flow path") are provided. That is to say, refrigerant of a plurality of systems, which is the first flow path and the second flow path, can be made to flow in the reserve tank. Also, in this reserve tank, refrigerant can be made to flow over a flow path that flows from the first inflow port to the second outflow port, via the first chamber, the refrigerant flow ports, the intermediate chamber, and the second chamber (hereinafter referred to as "third flow path"). Thus, in this reserve tank, flow paths of the refrigerant can be switched internally. In a state in which the refrigerant is flowing on the first flow path and the refrigerant is also flowing on the second flow path, and the refrigerant on the first flow path and the refrigerant on the second flow path become intermingled, the temperatures of the refrigerant on the first flow path and the refrigerant on the second flow path become averaged, and efficiency of cooling by the refrigerant decreases. However, in this reserve tank, the specific refrigerant flow port provided in the specific partition wall has a first through hole and a second through hole that are separated from each other, and accordingly the refrigerant on the first flow path and the refrigerant on the second flow path are suppressed from becoming intermingled. That is to say, upon the refrigerant existing in one of the two chambers separated by the specific partition wall (hereinafter referred to as "first specific chamber") flowing into the other chamber (hereinafter referred to as "second specific chamber") through the first through hole, the refrigerant that has flowed into the second specific chamber can return to the first specific chamber through the second through hole. Thus, when the specific refrigerant flow port has the first through hole and the second through hole that are separated from each other, a flow is readily generated in which the refrigerant that has flowed from the first specific chamber into the second specific chamber returns from the second specific chamber to the first specific chamber. Accordingly, the refrigerant flowing from the first specific chamber into the second specific chamber can return to the first specific chamber in a short time. Therefore, according to the reserve tank of the first aspect of the present disclosure, the refrigerant on the first flow path and the refrigerant on the second flow path can be suppressed from becoming intermingled.

In the reserve tank according to the first aspect of the present disclosure, the second through hole may be situated below the first through hole.

According to the reserve tank of the first aspect of the present disclosure, when the chamber adjacent to the specific partition wall has an elongated shape in the longitudinal direction, a flow of refrigerant that is long in the longitudinal direction can be generated in the chamber. Thus, stagnation of refrigerant inside the chamber that is elongated in the longitudinal direction can be suppressed.

In the reserve tank according to the first aspect of the present disclosure, the at least one intermediate chamber may be a plurality of intermediate chambers.

In the reserve tank according to the first aspect of the present disclosure, the at least one intermediate chamber may include a first intermediate chamber adjacent to the first chamber, and a second intermediate chamber adjacent to the second chamber and also adjacent to the first intermediate chamber. The partition walls may include an intermediate partition wall separating the first intermediate chamber and the second intermediate chamber. The refrigerant flow ports may include an intermediate refrigerant flow port provided in the intermediate partition wall. The first refrigerant flow port may be the specific refrigerant flow port. The first through hole and the second refrigerant flow port may be provided at heights at least partially overlapping. The intermediate refrigerant flow port may be provided at a height that does not overlap with at least one of the first through hole and the second refrigerant flow port. The intermediate partition wall may be disposed between the first through hole and the second refrigerant flow port.

According to the reserve tank of the first aspect of the present disclosure, the intermediate partition wall exists between the first through hole and the second refrigerant flow port, and accordingly the refrigerant does not readily flow between the first through hole and the second refrigerant flow port. Therefore, the flow of the refrigerant in the first refrigerant flow port and the flow of the refrigerant in the second refrigerant flow port do not readily intermingle.

In the reserve tank according to the first aspect of the present disclosure, the second refrigerant flow port may be configured of a single through hole, and the intermediate refrigerant flow port may be configured of a single through hole.

Also, a refrigerant circuit according to a second aspect of the present disclosure may include any one of the above reserve tanks, and a switching valve. The switching valve may be configured to switch flow paths of the refrigerant flowing through the first inflow port, the first outflow port, the second inflow port, and the second outflow port, and may be configured to switch the flow paths between a first state and a second state. The first state may be a state in which the refrigerant flows from the first inflow port to the first outflow port and the refrigerant also flows from the second inflow port to the second outflow port, and the second state may be a state in which the refrigerant flows from the first inflow port to the second outflow port.

In the refrigerant circuit according to the second aspect of the present disclosure, in the first state, a temperature of the refrigerant in the first chamber may be higher than a temperature of the refrigerant in the second chamber.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Figure 1:
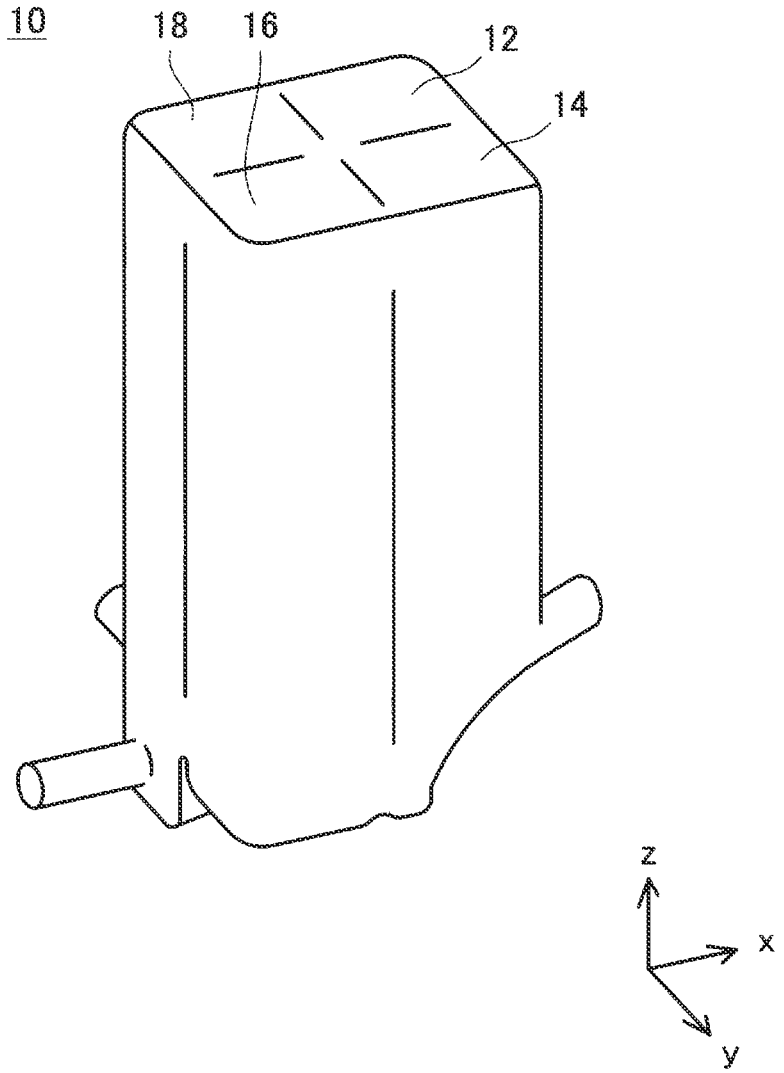
FIG. 1 is a perspective view of a reserve tank according to an embodiment.
Figure 2:
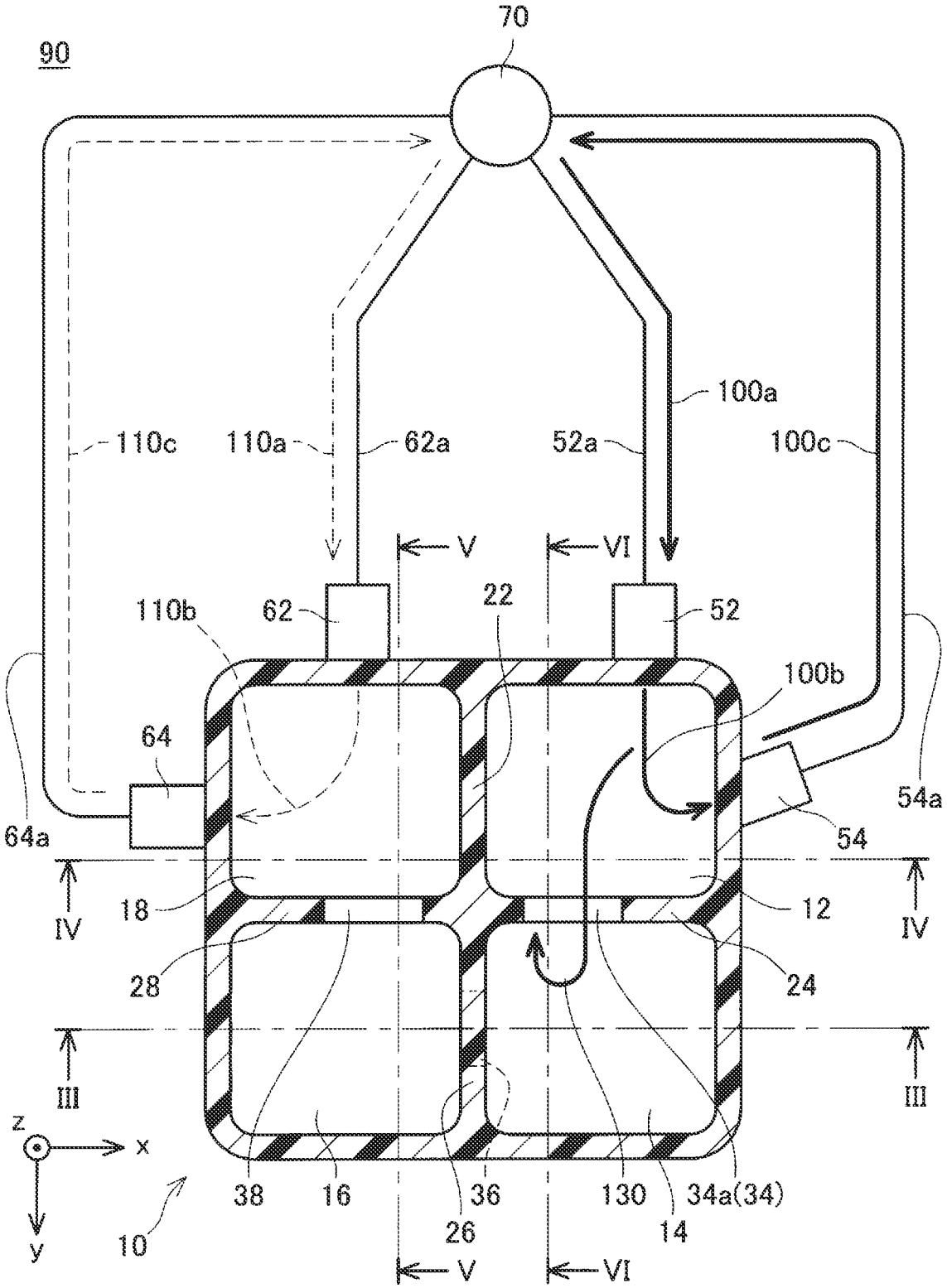
FIG. 2 is a cross-sectional view of the reserve tank according to the embodiment (cross-sectional view taken along line II-II in FIGS. 3 to 6, illustrating a first circulation path and a second circulation path)

A reserve tank 10 according to an embodiment illustrated in FIG. 1 is installed in a vehicle, for example. Refrigerant that cools each part of the vehicle flows through the reserve tank 10. The reserve tank 10 removes air bubbles from the refrigerant. In the following, a vertically upward direction will be referred to as "z direction", one direction parallel to a horizontal plane will be referred to as "x direction", and a direction parallel to the horizontal plane and orthogonal to the x direction will be referred to as "y direction", as illustrated in FIG. 1. As illustrated in FIG. 2, the reserve tank 10 has a substantially rectangular cross-sectional shape. Inside the reserve tank 10, partition walls 22, 24, 26, and 28 are provided extending in four ways from a substantially center portion of the reserve tank 10. The internal space of the reserve tank 10 is divided into four chambers 12, 14, 16, and 18, by the partition walls 22, 24, 26, and 28. The chamber 12 is adjacent to the chamber 18 in the x direction. The partition wall 22 is provided between the chamber 12 and the chamber 18. The chamber 12 is adjacent to the chamber 14 in the y direction. The partition wall 24 is provided between the chamber 12 and the chamber 14. The chamber 14 is adjacent to the chamber 16 in the x direction. The partition wall 26 is provided between the chamber 14 and the chamber 16. The chamber 16 is adjacent to the chamber 18 in the y direction. The partition wall 28 is provided between the chamber 16 and the chamber 18. As illustrated in FIGS. 3 to 6, each of the chambers 12, 14, 16, and 18 has a shape that is elongated in the z direction.

As illustrated in FIGS. 3 to 6, refrigerant 80 is stored in each of the chambers 12, 14, 16, and 18. In each of the chambers 12, 14, 16, and 18, a liquid level 80*a* of the refrigerant 80 exists at a position lower than a ceiling. In each of the chambers 12, 14, 16, and 18, air exists in the space above the liquid level 80*a*. As illustrated in FIGS. 2 to 6, the partition walls 24, 26, and 28 are provided with refrigerant flow ports 34, 36, and 38. The refrigerant flow ports 34, 36, and 38 are provided below the liquid level 80*a*. The refrigerant 80 is capable of flowing among the chambers 12, 14, 16, and 18, through the refrigerant flow ports 34, 36, and 38. As illustrated in FIGS. 3 to 6, the partition walls 22, 24, 26, and 28 are provided with air flow ports 42, 44, 46, and 48. The air flow ports 42, 44, 46, and 48 are provided above the liquid level 80*a*. Air is capable of flowing among the chambers 12, 14, 16, and 18 through the air flow ports 42, 44, 46, and 48. Providing the air flow ports 42, 44, 46, and 48 enables the liquid levels of the refrigerant 80 in the chambers 12, 14, 16, and 18 to be equal to each other.

Figure 3:
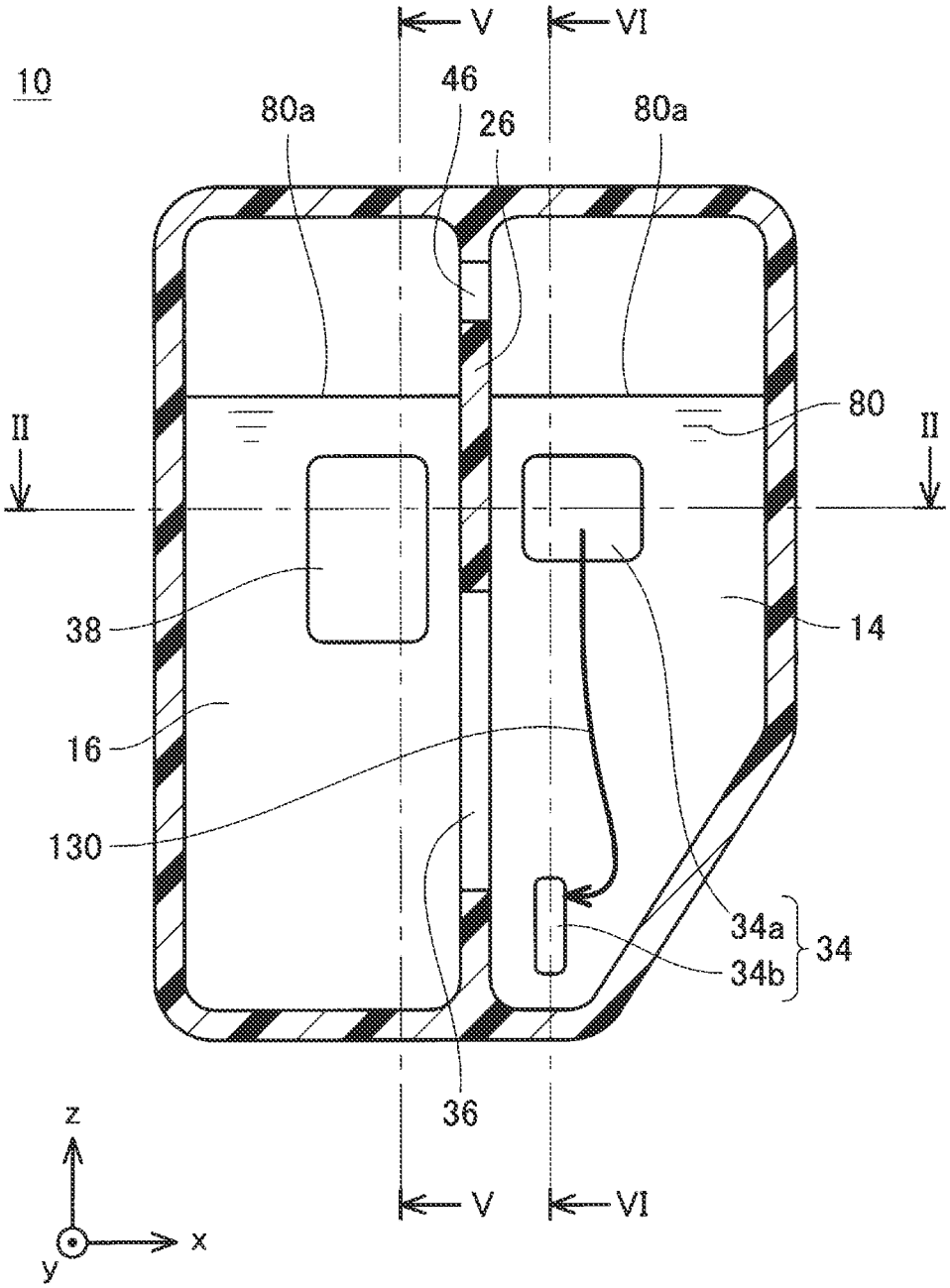
FIG. 3 is a longitudinal-sectional view of the reserve tank according to the embodiment (sectional view taken along line III-III in FIGS. 2, 5, and 6)
Figure 6:
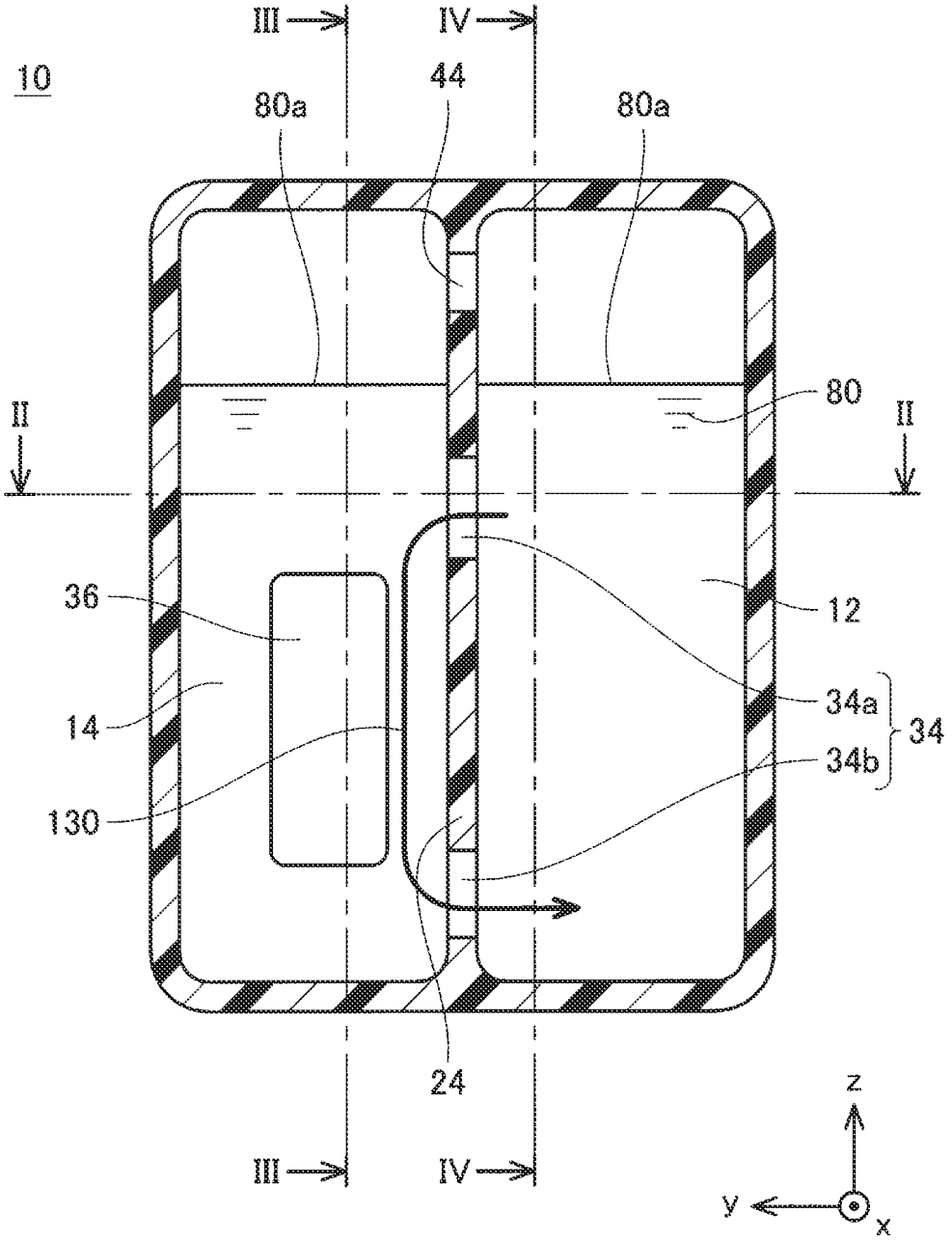
FIG. 6 is a longitudinal-sectional view of the reserve tank according to the embodiment (sectional view taken along line VI-VI in FIGS. 2 to 4)

As illustrated in FIGS. 3 and 6, the refrigerant flow port 34 has a first through hole 34*a* and a second through hole 34*b*. The first through hole 34*a* and the second through hole 34*b* are separated from each other. Each of the first through hole 34*a* and the second through hole 34*b* passes through the partition wall 24. The second through hole 34*b* is situated below the first through hole 34*a*. The first through hole 34*a* is situated in the proximity of the liquid level 80*a* of the refrigerant 80. The second through hole 34*b* is situated in the proximity of a bottom face of the reserve tank 10. The refrigerant 80 is capable of flowing between the chamber 12 and the chamber 14 through the refrigerant flow port 34 (i.e., the first through hole 34*a* and the second through hole 34*b*).

Figure 5:
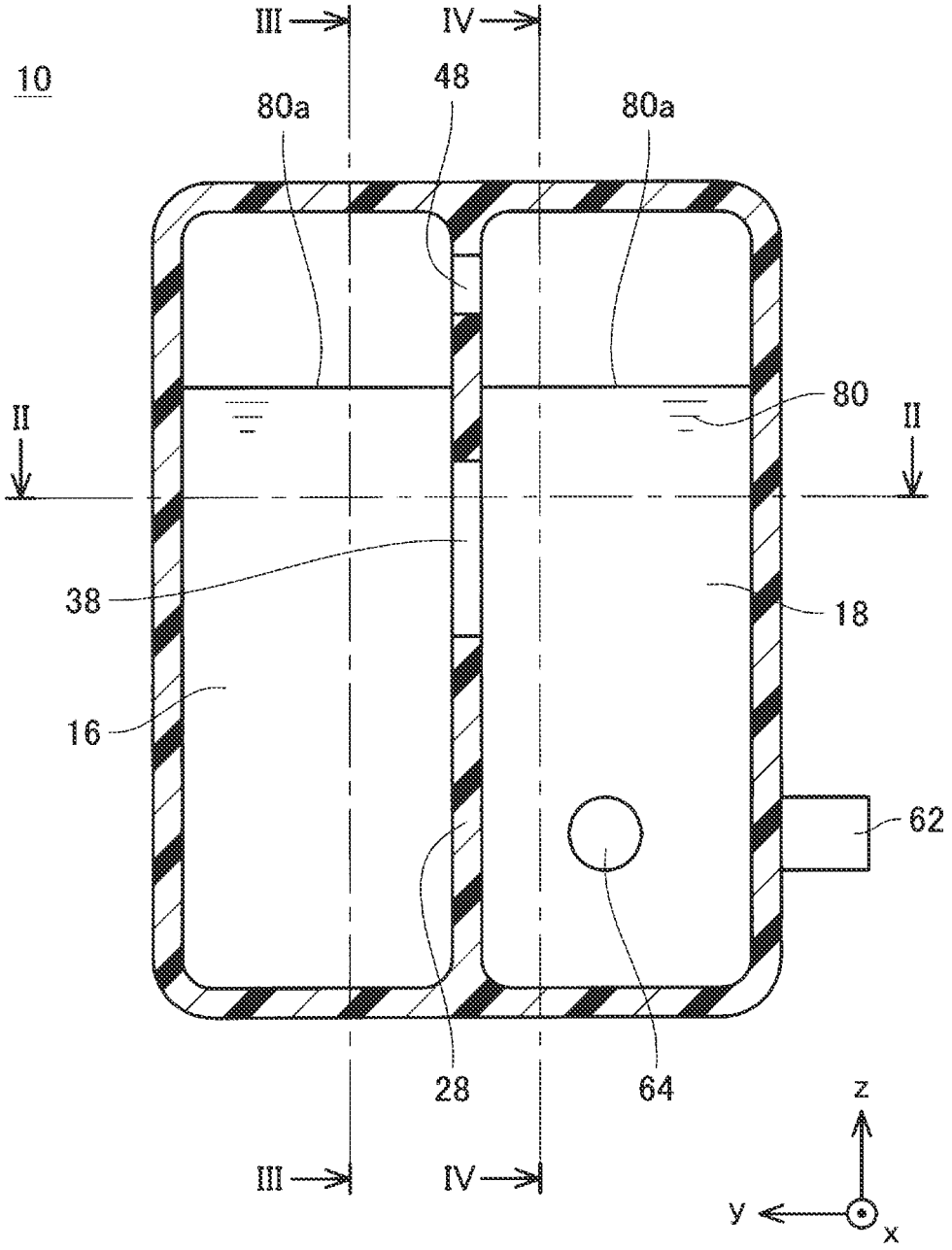
FIG. 5 is a longitudinal-sectional view of the reserve tank according to the embodiment (sectional view taken along line V-V in FIGS. 2 to 4)

As illustrated in FIGS. 3 and 5, the refrigerant flow port 38 is configured of a single through hole passing through the partition wall 28. The refrigerant 80 is capable of flowing between the chamber 16 and the chamber 18 through the refrigerant flow port 38. As illustrated in FIG. 3, the refrigerant flow port 38 is situated at a height overlapping the first through hole 34*a*.

As illustrated in FIGS. 3 and 6, the refrigerant flow port 36 is configured of a single through hole passing through the partition wall 26. The refrigerant 80 is capable of flowing between the chamber 14 and the chamber 16 through the refrigerant flow port 36. As illustrated in FIG. 3, the refrigerant flow port 36 is situated below the lower end of the first through hole 34*a*. Thus, the refrigerant flow port 36 does not exist between the first through hole 34*a* and the refrigerant flow port 38, and the partition wall 26 exists therebetween.

Figure 4:
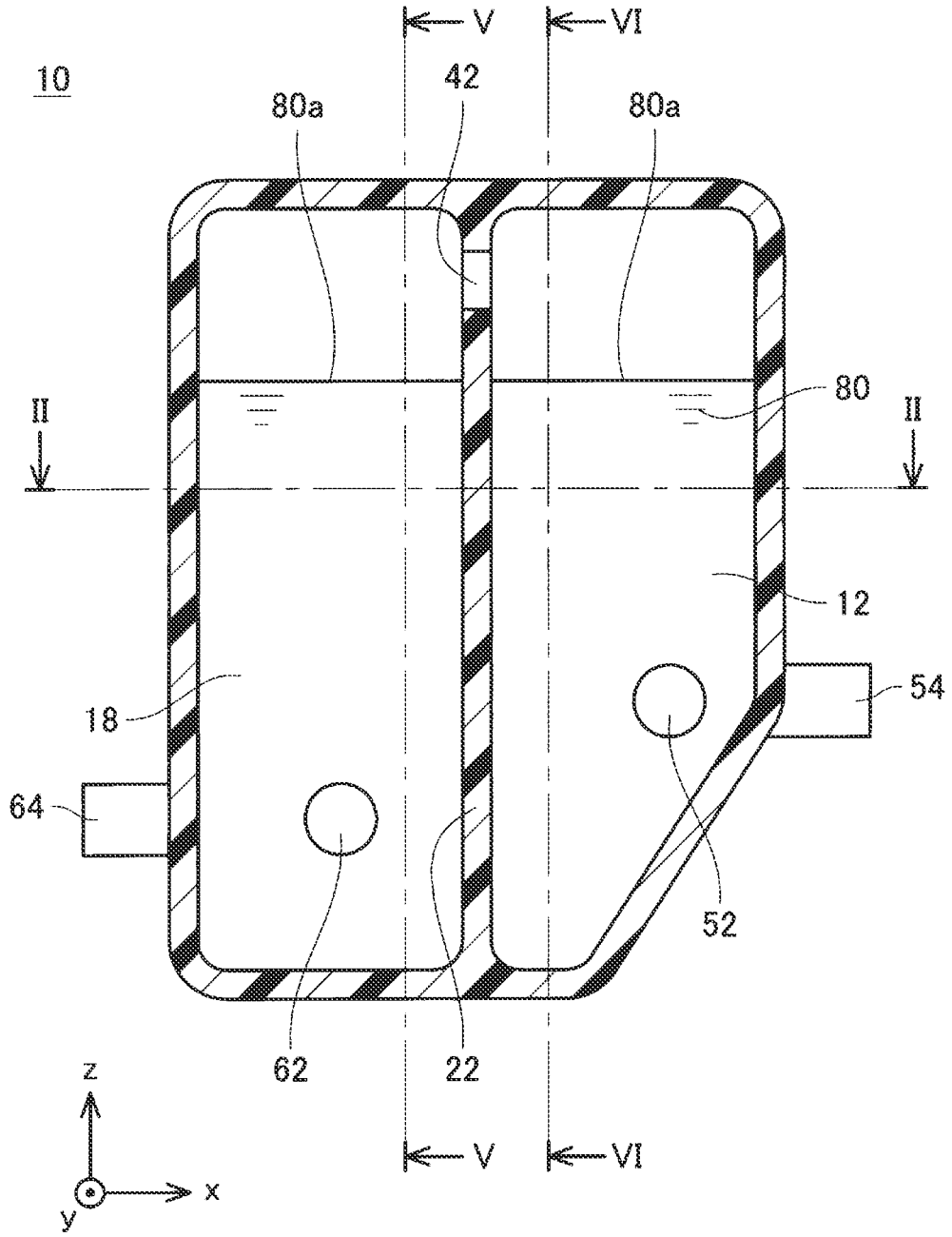
FIG. 4 is a longitudinal-sectional view of the reserve tank according to the embodiment (sectional view taken along line IV-IV in FIGS. 2, 5, and 6)

As illustrated in FIG. 4, the partition wall 22 is not provided with a refrigerant flow port. Accordingly, the refrigerant 80 cannot flow directly between the chamber 12 and the chamber 18. Note, however, that as indicated by arrow 120*b* in FIG. 7, the refrigerant 80 is capable of flowing between the chamber 12 and the chamber 18 via the refrigerant flow port 34, the chamber 14, the refrigerant flow port 36, the chamber 16, and the refrigerant flow port 38.

As illustrated in FIG. 2, the chamber 12 is provided with a refrigerant inflow port 52 and a refrigerant outflow port 54. One end of a refrigerant supply pipe 52*a* is connected to the refrigerant inflow port 52. The other end of the refrigerant supply pipe 52*a* is connected to a switching valve 70. The refrigerant 80 is capable of flowing from the refrigerant supply pipe 52*a* into the chamber 12 via the refrigerant inflow port 52. One end of a refrigerant discharge pipe 54*a* is connected to the refrigerant outflow port 54. The other end of the refrigerant discharge pipe 54*a* is connected to the switching valve 70. The refrigerant 80 is capable of flowing out from the chamber 12 to the refrigerant discharge pipe 54*a* via the refrigerant outflow port 54.

As illustrated in FIG. 2, the chamber 18 is provided with a refrigerant inflow port 62 and a refrigerant outflow port 64. One end of an external refrigerant supply pipe 62*a* is connected to the refrigerant inflow port 62. The other end of the refrigerant supply pipe 62*a* is connected to the switching valve 70. The refrigerant 80 is capable of flowing from the refrigerant supply pipe 62*a* into the chamber 18 via the refrigerant inflow port 62. One end of an external refrigerant discharge pipe 64*a* is connected to the refrigerant outflow port 64. The other end of the refrigerant discharge pipe 64*a* is connected to the switching valve 70. The refrigerant 80 is capable of flowing out from the chamber 18 to the refrigerant discharge pipe 64*a* via the refrigerant outflow port 64.

As illustrated in FIG. 2, a refrigerant circuit 90 is configured of the reserve tank 10, the refrigerant supply pipe 52*a*, the refrigerant discharge pipe 54*a*, the refrigerant supply pipe 62*a*, the refrigerant discharge pipe 64*a*, and the switching valve 70. Provided to the refrigerant supply pipe 52*a*, the refrigerant discharge pipe 54*a*, the refrigerant supply pipe 62*a*, and the refrigerant discharge pipe 64*a*, is a cooling object device to be cooled by the refrigerant 80, a heat exchanger for cooling the refrigerant 80, a pump for circulating the refrigerant 80, and so forth, although omitted from illustration.

The switching valve 70 can switch the connection state of piping between a first state and a second state. FIG. 2 illustrates the first state, and FIG. 7 illustrates the second state.

In the first state illustrated in FIG. 2, the switching valve 70 causes the refrigerant 80 to flow from the refrigerant discharge pipe 54*a* to the refrigerant supply pipe 52*a*. In this state, as indicated by arrows 100*a* to 100*c* in FIG. 2, the refrigerant 80 can be circulated on a first circulation path configured of the refrigerant supply pipe 52*a*, the chamber 12, and the refrigerant discharge pipe 54*a*. That is to say, on the first circulation path, a flow from the refrigerant inflow port 52 to the refrigerant outflow port 54 is generated in the chamber 12, as indicated by arrow 100*b*.

In the first state illustrated in FIG. 2, the switching valve 70 causes the refrigerant 80 to flow from the refrigerant discharge pipe 64*a* to the refrigerant supply pipe 62*a*. In this state, the refrigerant 80 can be circulated on a second circulation path configured of the refrigerant supply pipe 62*a*, the chamber 18, and the refrigerant discharge pipe 64*a*, as indicated by arrows 110*a* to 110*c* in FIG. 2. That is to say, on the second circulation path, a flow from the refrigerant inflow port 62 to the refrigerant outflow port 64 is generated in the chamber 18, as indicated by arrow 110*b*. In the first state, the refrigerant 80 can be circulated on the first circulation path and the second circulation path at the same time. In a state in which the refrigerant 80 is circulated on the first circulation path and the second circulation path at the same time, the temperature of the refrigerant 80 in the chamber 12 becomes higher than the temperature of the refrigerant 80 in the chamber 18.

Figure 7:
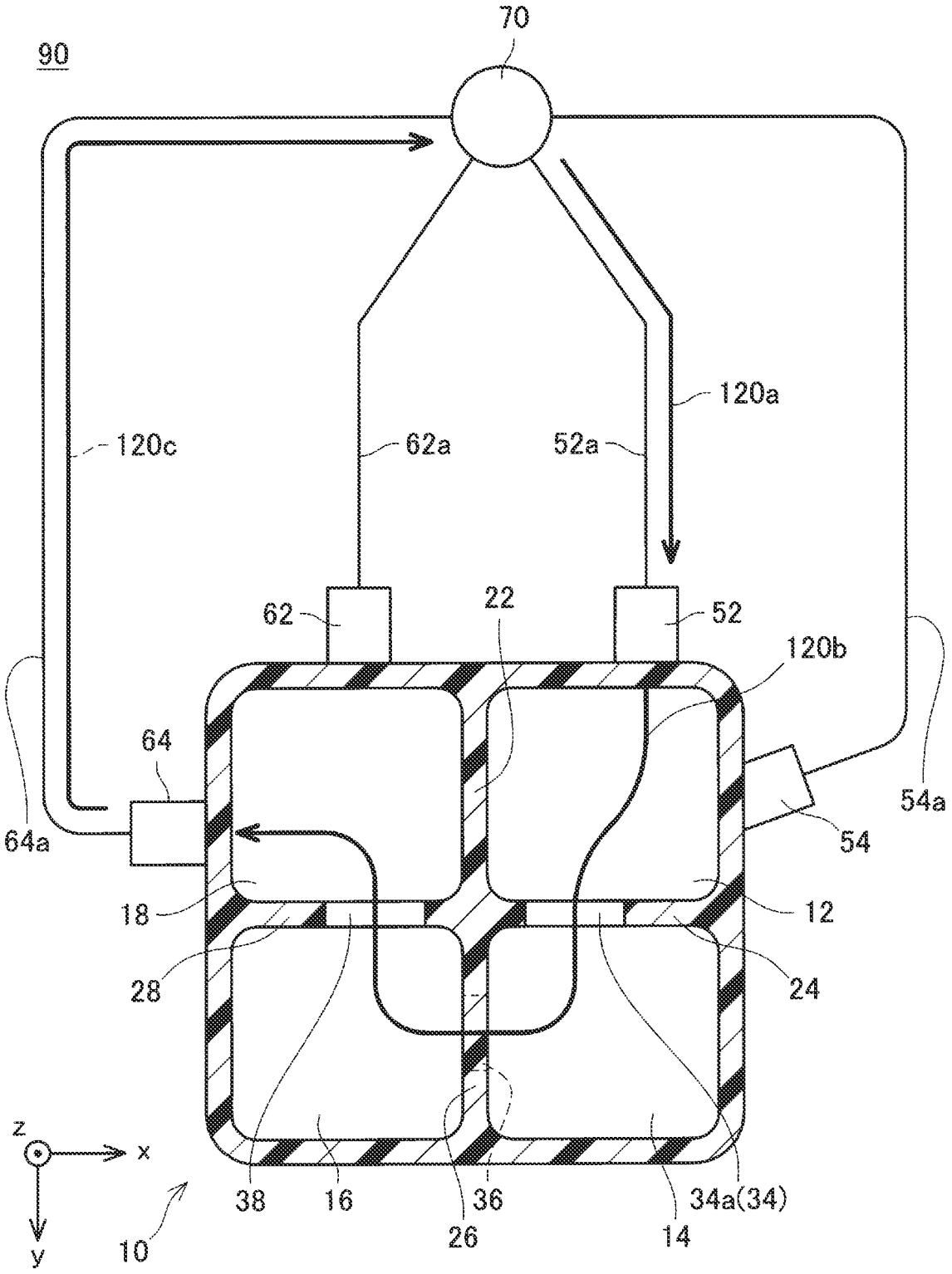
FIG. 7 is a diagram illustrating a third circulation path in the same cross-section as in FIG. 2.

In the second state illustrated in FIG. 7, the switching valve 70 causes the refrigerant 80 to flow from the refrigerant discharge pipe 64*a* to the refrigerant supply pipe 52*a*. In this state, the refrigerant 80 can be circulated on a third circulation path configured of the refrigerant supply pipe 52*a*, the chambers 12 through 18, and the refrigerant discharge pipe 64*a*, as indicated by arrows 120*a* to 120*c* in FIG. 7. That is to say, on the third circulation path, a flow is generated in the reserve tank 10, flowing from the refrigerant inflow port 52 via the chamber 12, the refrigerant flow port 34, the chamber 14, the refrigerant flow port 36, the chamber 16, the refrigerant flow port 38, and the chamber 18, toward the refrigerant outflow port 64, as indicated by arrow 120*b*.

As described above, by setting the switching valve 70 to the first state in the refrigerant circuit 90, the refrigerant 80 of two different systems (that is, the first circulation path and the second circulation path) can be made to flow into the reserve tank 10. Also, by switching the switching valve 70 to the second state in the refrigerant circuit 90, the flow paths of the refrigerant 80 inside the reserve tank can be switched and the refrigerant 80 can flow on the third circulation path. When the refrigerant 80 is flowing on any of the first circulation path, the second circulation path, and the third circulation path, air bubbles in the refrigerant 80 rise toward the liquid level 80*a* in the reserve tank 10 and disappear at the liquid level 80*a*. Thus, air is removed from the refrigerant 80.

As described above, the chamber 12 and the chamber 18 are connected to each other via the refrigerant flow port 34, the chamber 14, the refrigerant flow port 36, the chamber 16, and the refrigerant flow port 38. Accordingly, when the refrigerant 80 is circulated on the first circulation path and the second circulation path at the same time as illustrated in FIG. 2, high-temperature refrigerant 80 in the chamber 12 and low-temperature refrigerant 80 in the chamber 18 become intermingled within the reserve tank 10. When a large amount of the refrigerant 80 in the chamber 12 and the refrigerant 80 in the chamber 18 become intermingled, the temperature difference between the refrigerant 80 in the chamber 12 and the refrigerant 80 in the chamber 18 becomes small. In this way, when the temperature becomes uniform between the refrigerant 80 in the chamber 12 and the refrigerant 80 in the chamber 18, cooling efficiency is reduced on each of the first circulation path and the second circulation path. However, in the refrigerant circuit 90 of the present embodiment, the temperatures of the refrigerant 80 in the chamber 12 and the refrigerant 80 in the chamber 18 are suppressed from becoming uniform, as described below.

As described above, the refrigerant flow port 34 provided in the partition wall 24 has the first through hole 34*a* and the second through hole 34*b*. In a state in which the refrigerant 80 circulates on the first circulation path as indicated by arrows 100*a*, 100*b*, and 100*c* in FIG. 2, the refrigerant 80 flows into the chamber 12 from the refrigerant inflow port 52, thereby generating a flow of the refrigerant 80 in the chamber 12. Part of the refrigerant 80 in the chamber 12 flows into the chamber 14 through the first through hole 34*a*, as indicated by arrow 130 in FIGS. 2, 3, and 6. A great part of the refrigerant 80 that has flowed from the chamber 12 into the chamber 14 flows downward in the chamber 14, and returns to the chamber 12 through the second through hole 34*b*. That is to say, in the first through hole 34*a*, a stable flow of the refrigerant 80 flowing from the chamber 12 to the chamber 14 is generated, and in the second through hole 34*b*, a stable flow of the refrigerant 80 flowing from the chamber 14 to the chamber 12 is generated. Thus, a stable flow of the refrigerant 80 flowing from the chamber 12 to the chamber 14 and returning to the chamber 12 (the flow indicated by arrow 130) is generated. Accordingly, a great part of the refrigerant 80 that has flowed from the chamber 12 to the chamber 14 can return to the chamber 12 in a short time. Thus, the refrigerant 80 in the chamber 12 can be suppressed from becoming intermingled with the refrigerant 80 in the chambers 16 and 18 via the chamber 14. As described above, the refrigerant flow port 34 has the first through hole 34*a* and the second through hole 34*b* separated from each other, and accordingly the refrigerant 80 can be suppressed from becoming intermingled between the chambers 12 and 18. Further, a great part of the refrigerant 80 flowing from the chamber 12 to the chamber 14 returns to the chamber 12 in a short time, and accordingly the temperature of the refrigerant 80 in the chamber 14 does not readily rise. Therefore, heat does not readily travel between the chamber 14 and the chamber 16. Thus, heat does not readily travel between the chamber 12 and the chamber 18 via the chamber 14 and the chamber 16. In this way, intermingling of the refrigerant 80 in the chamber 12 and the refrigerant 80 in the chamber 18, and heat traveling between the refrigerant 80 in the chamber 12 and the refrigerant 80 in the chamber 18, are suppressed. Accordingly, the temperature is suppressed from becoming uniform between the refrigerant 80 in the chamber 12 and the refrigerant 80 in the chamber 18 in the reserve tank 10.

Further, as illustrated in FIG. 3, while the first through hole 34*a* and the refrigerant flow port 38 are situated at heights overlapping each other, the refrigerant flow port 36 is situated below the lower end of the first through hole 34*a*. Accordingly, the partition wall 26 exists between the first through hole 34*a* and the refrigerant flow port 38. Therefore, a flow of the refrigerant 80 from the first through hole 34*a* toward the refrigerant flow port 38 is not readily generated. This also suppresses the refrigerant 80 in the chamber 12 and the refrigerant 80 in the chamber 18 from becoming intermingled. Accordingly, the temperature between the refrigerant 80 in the chamber 12 and the refrigerant 80 in the chamber 18 is more effectively suppressed from becoming uniform.

Also, in the reserve tank 10, the chamber 14 has an elongated shape in the up-down direction. Further, the first through hole 34*a* and the second through hole 34*b* are situated separated in the up-down direction. Accordingly, a flow is generated along the up-down direction in the chamber 14, as indicated by arrow 130 in FIGS. 3 and 6. Thus, a situation in which part of the refrigerant 80 in the chamber 14 is retained within the chamber 14 for a long time can be suppressed. Therefore, deterioration of the refrigerant 80 in the chamber 14 can be suppressed.

Note that in the above-described embodiment, the refrigerant flow port 34 has a plurality of through holes. However, the refrigerant flow port 36 may have a plurality of through holes, and the refrigerant flow port 38 may have a plurality of through holes. In this case, the refrigerant flow port 34 may be configured of a single through hole. However, in an arrangement in which the refrigerant flow port 34 between the chamber 12 having the highest temperature and the chamber 14 connected to the chamber 12 has a plurality of through holes, the temperatures of the refrigerant 80 in the chamber 12 and the refrigerant 80 in the chamber 18 can be more effectively suppressed from becoming uniform.

Also, in the above-described embodiment, the chambers 14 and 16 (i.e., intermediate chambers) are provided between the chamber 12 and the chamber 18 connected to external piping of the reserve tank 10. However, the number of intermediate chambers provided between the chamber 12 and the chamber 18 may be one, or may be three or more. In this case, the refrigerant flow port provided in any one of the partition walls can be configured of a plurality of through holes.

Also, in the above-described embodiment, the refrigerant flow port 36 is provided at a height that does not overlap the first through hole 34*a*, while the refrigerant flow port 36 is provided at a height that partially overlaps the refrigerant flow port 38. However, the refrigerant flow port 36 may be provided at a height that overlaps neither the first through hole 34*a* nor the refrigerant flow port 38. Moreover, the refrigerant flow port 36 may be provided at a height that overlaps the first through hole 34*a* and does not overlap the refrigerant flow port 38.

The chamber 12 according to the embodiment is an example of a first chamber. The chamber 18 according to the embodiment is an example of a second chamber. The chambers 14 and 16 according to the embodiment are examples of intermediate chambers. The partition wall 24 according to the embodiment is an example of a first partition wall. The partition wall 28 according to the embodiment is an example of a second partition wall. The partition wall 24 according to the embodiment is an example of a specific partition wall. The refrigerant flow port 34 according to the embodiment is an example of a specific refrigerant flow port. The partition wall 26 according to the embodiment is an example of an intermediate partition wall. The refrigerant flow port 34 according to the embodiment is an example of a first refrigerant flow port. The refrigerant flow port 38 according to the embodiment is an example of a second refrigerant flow port. The refrigerant flow port 36 according to the embodiment is an example of an intermediate refrigerant flow port.

Although the embodiment has been described in detail above, the embodiment is merely an example and does not limit the scope of the claims. The technology described in the claims includes various modifications and alternations of the specific examples exemplified above. The technical elements described in the present specification and the drawings exhibit technical utility alone or in various combinations, and are not limited to the combinations described in the claims at the time of filing. Also, the technology exemplified in the present specification and the drawings achieve a plurality of objects at the same time, and achieving one of the objects itself has technological utility.

What is claimed is:

1. A refrigerant circuit comprising:

a reserve tank comprising:

a plurality of chambers, including a first chamber, a second chamber, and at least one intermediate chamber;

a first inflow port connected to the first chamber;

a first outflow port connected to the first chamber;

a second inflow port connected to the second chamber;

a second outflow port connected to the second chamber; and a plurality of partition walls separating the chambers, including a first partition wall and a second partition wall, the first partition wall separating between the first chamber and the at least one intermediate chamber, the second partition wall separating between the second chamber and the at least one intermediate chamber, each of the partition walls being provided with a corresponding one of a plurality of refrigerant flow ports, the refrigerant flow ports including a first refrigerant flow port provided in the first partition wall and a second refrigerant flow port provided in the second partition wall, and being configured such that refrigerant flows from the first chamber to the second chamber via the at least one intermediate chamber and the refrigerant flow ports, and a specific refrigerant flow port including a first through hole and a second through hole that pass through a specific partition wall and are separated from each other, the specific refrigerant flow port being the refrigerant flow port provided in the specific partition wall among the partition walls; and a switching valve configured to switch flow paths of refrigerant flowing through the first inflow port, the first outflow port, the second inflow port, and the second outflow port, and configured to switch the flow paths between a first state and a second state, the first state being a state in which the refrigerant flows from the first inflow port to the first outflow port and the refrigerant also flows from the second inflow port to the second outflow port, and the second state being a state in which the refrigerant flows from the first inflow port to the second outflow port.

2. The refrigerant circuit according to claim 1, wherein the second through hole is situated below the first through hole.

3. The refrigerant circuit according to claim 1, wherein the at least one intermediate chamber is a plurality of intermediate chambers.

4. The refrigerant circuit according to claim 1, wherein:

the at least one intermediate chamber includes a first intermediate chamber adjacent to the first chamber, and a second intermediate chamber adjacent to the second chamber and also adjacent to the first intermediate chamber;

the partition walls include an intermediate partition wall separating the first intermediate chamber and the second intermediate chamber;

the refrigerant flow ports include an intermediate refrigerant flow port provided in the intermediate partition wall;

the first refrigerant flow port is the specific refrigerant flow port;

the first through hole and the second refrigerant flow port are provided at heights at least partially overlapping;

the intermediate refrigerant flow port is provided at a height that does not overlap with at least one of the first through hole and the second refrigerant flow port; and the intermediate partition wall is disposed between the first through hole and the second refrigerant flow port.

5. The refrigerant circuit according to claim 4, wherein the second refrigerant flow port is configured of a single through hole, and the intermediate refrigerant flow port is configured of a single through hole.

6. The refrigerant circuit according to claim 1, wherein in the first state, a temperature of the refrigerant in the first chamber is higher than a temperature of the refrigerant in the second chamber.

* * * * *